US012435524B2

(12) United States Patent
Ceysson

(10) Patent No.: US 12,435,524 B2
(45) **Date of Patent: *Oct. 7, 2025**

(54) PANEL FOR PRODUCING A FREE-LYING FLOOR COVERING

(71) Applicant: Gerflor, Villeurbanne (FR)

(72) Inventor: Olivier Ceysson, Bollene (FR)

(73) Assignee: Gerflor, Villeurbanne (FR)

( * ) Notice: Subject to any disclaimer, the term of this patent is extended or adjusted under 35 U.S.C. 154(b) by 0 days.

This patent is subject to a terminal disclaimer.

(21) Appl. No.: 18/389,873

(22) Filed: Dec. 20, 2023

(65) Prior Publication Data

US 2024/0117641 A1 Apr. 11, 2024

Related U.S. Application Data

(63) Continuation of application No. 17/415,745, filed as application No. PCT/FR2019/053128 on Dec. 17, 2019, now Pat. No. 11,891,816.

(30) Foreign Application Priority Data

Dec. 21, 2018 (FR) ..... 1873754

(51) Int. Cl.
*E04F 15/00* (2006.01)
*E04F 15/02* (2006.01)

(52) U.S. Cl.
CPC ..... *E04F 15/02038* (2013.01); *E04F 2201/0138* (2013.01); *E04F 2201/0153* (2013.01);
(Continued)

(58) Field of Classification Search
CPC ..... E04F 15/02033; E04F 15/02038; E04F 15/107; E04F 15/102; E04F 2201/042;
(Continued)

(56) References Cited

U.S. PATENT DOCUMENTS 6,536,178 B1 3/2003 Palsson et al.
6,647,690 B1 * 11/2003 Martensson ..... E04F 15/04 52/489.1

(Continued)

FOREIGN PATENT DOCUMENTS

| | | |
|---|---|---|
| CN | 102137978 | 7/2011 |
| WO | WO 97/47834 | 12/1997 |
| WO | WO 2016/030627 | 3/2016 |

OTHER PUBLICATIONS

Notice of Allowance Dated Sep. 28, 2023 from the US Patent and Trademark Office Re. U.S. Appl. No. 17/415,745. (5 pages).

(Continued)

*Primary Examiner* — Chi Q Nguyen

(57) ABSTRACT

A panel having the shape of a plank or a tile for the production of a floor covering, comprising two pairs of opposed sides defining:

a first two opposed edges for inclined assembly a second two opposed edges for vertical assembly—the male coupling of the edges for the vertical assembly comprise a male groove extending along the edge and opening onto the lower face of the panel—the female coupling of the edges for the vertical assembly comprise a female groove extending along the edge and opening onto the upper face of the panel—the male coupling of the edges for the vertical assembly comprise a lug or a notch and the female coupling means of the edges for the vertical assembly comprise a complementary notch or lug.

14 Claims, 2 Drawing Sheets

(52) U.S. Cl.
CPC ... *E04F 2201/023* (2013.01); *E04F 2201/042* (2013.01); *E04F 2201/043* (2013.01)

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; E04F 15/02005; E04F 2201/0115; E04F 2201/0161
See application file for complete search history.

(56) References Cited

U.S. PATENT DOCUMENTS

| | | | | |
|---|---|---|---|---|
| 8,763,340 | B2 * | 7/2014 | Pervan | E04F 15/02 52/582.2 |
| 9,874,035 | B2 | 1/2018 | Wagner | |
| 10,287,777 | B2 | 5/2019 | Boo | |
| 10,851,549 | B2 | 12/2020 | Boo | |
| 11,359,384 | B2 | 6/2022 | Markovski et al. | |
| 11,479,970 | B2 * | 10/2022 | Pervan | E04B 5/02 |
| 11,834,843 | B2 * | 12/2023 | Schacht | B32B 27/304 |
| 11,891,816 | B2 * | 2/2024 | Ceysson | E04F 15/02038 |
| 11,976,470 | B2 * | 5/2024 | Zorn | E04F 15/105 |
| 11,987,991 | B2 * | 5/2024 | Claerhout | F16B 5/0056 |
| 2003/0145519 | A1 * | 8/2003 | Winsbury | A01G 31/02 47/62 R |
| 2007/0130872 | A1 | 6/2007 | Goodwin et al. | |
| 2010/0037550 | A1 * | 2/2010 | Braun | E04G 23/006 52/588.1 |
| 2011/0131909 | A1 | 6/2011 | Hannig | |
| 2011/0138722 | A1 | 6/2011 | Hannig | |
| 2011/0258959 | A1 | 10/2011 | Braun | |
| 2017/0370109 | A1 | 12/2017 | Devos | |
| 2019/0211569 | A1 | 7/2019 | Boo et al. | |
| 2020/0181923 | A1 * | 6/2020 | Quist | E04F 15/02155 |
| 2021/0381256 | A1 | 12/2021 | Ceysson | |

OTHER PUBLICATIONS

Official Action Dated Jul. 6, 2023 from the US Patent and Trademark Office Re. U.S. Appl. No. 17/415,745. (6 pages).
Official Action Dated Jan. 26, 2023 from the US Patent and Trademark Office Re. U.S. Appl. No. 17/415,745. (14 pages).
Rapport de Recherche Internationale et l'Opinion Ecrite [International Search Report and the Written Opinion] Dated Mar. 12, 2020 From the International Searching Authority Re. Application No. PCT/FR2019/053128 and Its Translation Into English. (24 Pages).

* cited by examiner

PANEL FOR PRODUCING A FREE-LYING FLOOR COVERING

RELATED APPLICATIONS

This application is a continuation of U.S. patent application Ser. No. 17/415,745 filed on Jun. 18, 2021, now U.S. Pat. No. 11,891,816, which is a National Phase of PCT Patent Application No. PCT/FR2019/053128 having International Filing Date of Dec. 17, 2019, which claims the benefit of priority of French Patent Application No. 1873754 filed on Dec. 21, 2018. The contents of the above applications are all incorporated by reference as if fully set forth herein in their entirety.

FIELD AND BACKGROUND OF THE INVENTION

The present invention relates to the field of loose laid floor coverings, and more particularly relates to a panel, preferably produced from polyvinyl chloride, being in the shape of a plank or tile, for the production of a covering of this type, wherein assembly is carried out using an inclined movement on a first edge, and a vertical movement on an adjacent second edge.

In general, this type of panel comprises two pairs of opposed sides defining:

- two opposed edges for inclined assembly, wherein one edge comprises male coupling means provided from a lateral wall of the panel, and an opposed edge comprising complementary female coupling means provided from a lateral wall of the panel;
- two opposed edges for vertical assembly, wherein one edge comprises male coupling means provided from a lower face of the panel, and an opposed edge comprising complementary female coupling means provided from an upper face of the panel.

This type of panel is illustrated, for example, by the document EP 3 105 392 and the document US 2013/0309441. These documents both describe a panel having complementary first and second male/female coupling means on opposed pairs of sides in order to assemble similar panels for forming a floor covering. The means for coupling the short sides have complementary means for opposing vertical uncoupling, and outer walls which are inclined with respect to a vertical plane and orientated towards the inside of the panel. Assembly is carried out by inclining the panels along a long side and by locking them vertically on a short side.

The means described in the document EP 3 105 392 for opposing vertical uncoupling of the two panels, in particular in the form of bulges and cavities, are not optimally efficient.

Furthermore, the document US 2013/0309441 describes a female tongue with a chamfered portion at the level of the lower face of the panel, with a view to facilitating assembly of two panels, but which is not optimally efficient.

During the operation for fitting this type of floor covering, first of all, the fitter assembles the long side following an inclined direction of assembly, for example at an angle in the range 10° to 50°, and then, while retaining the angle of inclination of the panel, it is then slid laterally towards the preceding panel until it comes into abutment.

With the panel of document EP 3 105 392, and with reference to FIG. 1 which illustrates it, the male portion (A1) of the panel to be fitted comes into abutment against the female portion (A2) of the panel which has already been fitted, at the level of the upper portion of the panel. In practice, the outer lateral wall of the male portion, in particular located below the cavity (A3), is what comes into abutment against the upper inner stop of the female portion. Next, while the panel pivots downwards, it follows the inclined trajectory (R) so that it becomes assembled. Thus, the panel "pulls back" upon assembly, which means it has to be positioned slightly in front of its locking position, which makes the panel fitting operation more complicated. This disadvantage is also found in the panel described in US 2013/0309441.

SUMMARY OF THE INVENTION

Thus, one of the aims of the invention is to overcome the disadvantages mentioned above by proposing a panel for the production of a loose laid floor covering, wherein assembly is carried out in accordance with an inclined movement on one edge, then a vertical movement on an adjacent edge.

Another aim of the invention is to facilitate assembly of two similar panels and also to provide a panel with an optimal resistance to horizontal and vertical uncoupling, as well as a satisfactory appearance.

To this end, a panel has been developed with the shape of a plank or tile for the production of a floor covering, the panel comprising two pairs of opposed sides defining:

- two opposed edges for inclined assembly, wherein one edge comprises male coupling means provided from a lateral wall of the panel, and an opposed edge comprising complementary female coupling means provided from a lateral wall of the panel;
- two opposed edges for vertical assembly, wherein one edge comprises male coupling means provided from a lower face of the panel, and an opposed edge comprising complementary female coupling means provided from an upper face of the panel.

In accordance with the invention:

- the male coupling means of the edges for vertical assembly comprise a male groove extending along the edge and opening onto the lower face of the panel, in a manner such as to define a male tenon, the male tenon having an outer wall which is inclined with respect to a vertical plane and towards the outside of the panel;
- the female coupling means of the edges for vertical assembly comprise a female groove extending along the edge and opening onto the upper face of the panel, in a manner such as to define a female tenon;
- the male coupling means of the edges for vertical assembly comprise a lug or a notch and the female coupling means of the edges for vertical assembly comprise a complementary notch or lug which, after assembly of two adjacent panels, form abutment stops to counteract a vertical displacement between two adjacent assembled panels.

Thus, the movement for assembling the panel in accordance with the invention is inclined on one side, then the panel is pivoted vertically on an adjacent side.

Furthermore, the fact that the male tenon has an outer wall which is inclined with respect to a vertical plane and towards the outside of the panel encourages vertical assembly during the rotational movement. The fitter will position the panels abutting each other: the lower portion of the male tenon will come to bear against the upper portion of the female groove. In consequence, during fitting, the fitter will see the groove and can therefore easily position the outer wall of the male tenon level with the groove in order to commence assembly, Next, in an advantageous manner, the two panels move together during pivoting. It is therefore easier to accommodate machining constraints which are involved in the production of a perfect contact at the surface of the panels.

The presence of the lug and notch also means that the resistance to vertical uncoupling can be optimized, because the projecting angles of the lug and notch permit more effective locking than the bulges and cavities of the prior art.

Preferably, the outer female tenon comprises a portion which is chamfered at the level of the lower face of the panel and forms an angle of between 2° and 20° with respect to the lower face of the panel. The chamfered portion enables the female tenon to drop down during assembly of two adjacent panels in order to come into contact with the floor by deformation and therefore ensure a reduction in the force of assembly.

Advantageously, the chamfered portion of the female tenon extends to level with the upper inner ridge of the female tenon, i.e. in particular to level with the highest point of the female tenon from the floor. This feature provides for better bending of the female tenon during assembly.

In accordance with a particular embodiment, and to facilitate manufacture by machining, the male tenon has an inner wall which is inclined with respect to a vertical plane and towards the outside of the panel. As an example, the outer and inner walls of the male tenon are inclined at an angle of between 1° and 45°, and preferably of between 5° and 15°, and for example at the same angle.

Again to facilitate bending during assembly, the male tenon comprises a portion which is chamfered at the level of the upper face of the panel and which forms an angle of between 2° and 20° with respect to the upper face of the panel.

In order to further improve the vertical resistance to uncoupling, the male coupling means of the edges for vertical assembly comprise two lugs or notches, and the female coupling means of the edges for vertical assembly comprise two complementary notches or lugs.

In accordance with a particular exemplary embodiment, the lug or notch is provided on the outer wall of the male tenon, and in a complementary manner, the notch or lug is provided on an inner wall of the female groove.

In accordance with another example, alone or in combination with the preceding example, the lug or notch is provided on the outer wall of the female tenon and, in a complementary manner, the notch or lug is provided on an inner wall of the male groove.

In accordance with a particular embodiment, the male coupling means of the edges for inclined assembly comprise a tongue which protrudes, in particular orthogonally, from the lateral wall of the panel and over the entire length of the edge, and the female coupling means of the edges for inclined assembly comprise a complementary groove provided in the lateral wall of the panel and over the entire length of the edge.

Preferably, the tongue comprises a lug which protrudes vertically, and the complementary groove comprises a complementary notch which, after assembly of the two adjacent panels, forms abutment stops to counteract a horizontal displacement between two adjacent assembled panels.

Advantageously, the complementary groove of the female coupling means of the edges for inclined assembly defines a flexible lower female tongue which is intended to be displaced during inclined engagement of the tongue of the male coupling means, then to resume its position after engagement in order to increase the resistance of the two adjacent assembled panels to vertical and horizontal uncoupling.

BRIEF DESCRIPTION OF THE SEVERAL VIEWS OF THE DRAWINGS

Other advantages and features will become apparent from the following description of several embodiments, given by way of non-limiting examples of the panel in accordance with the invention, made with reference to the accompanying drawings in which.

DESCRIPTION OF SPECIFIC EMBODIMENTS OF THE INVENTION

Figure 1:
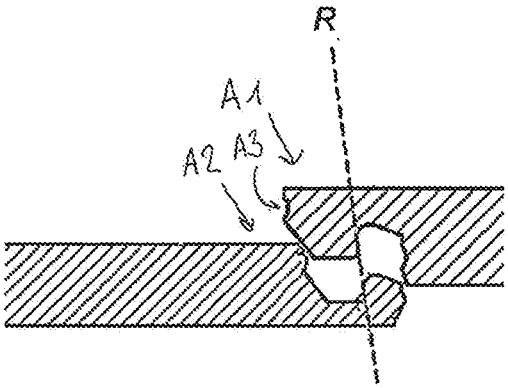
Fig. 1 (Prior Art)
FIG. 1 is a diagrammatic representation illustrating the male and female coupling means of a panel of the prior art making a vertical movement.
Figure 2:
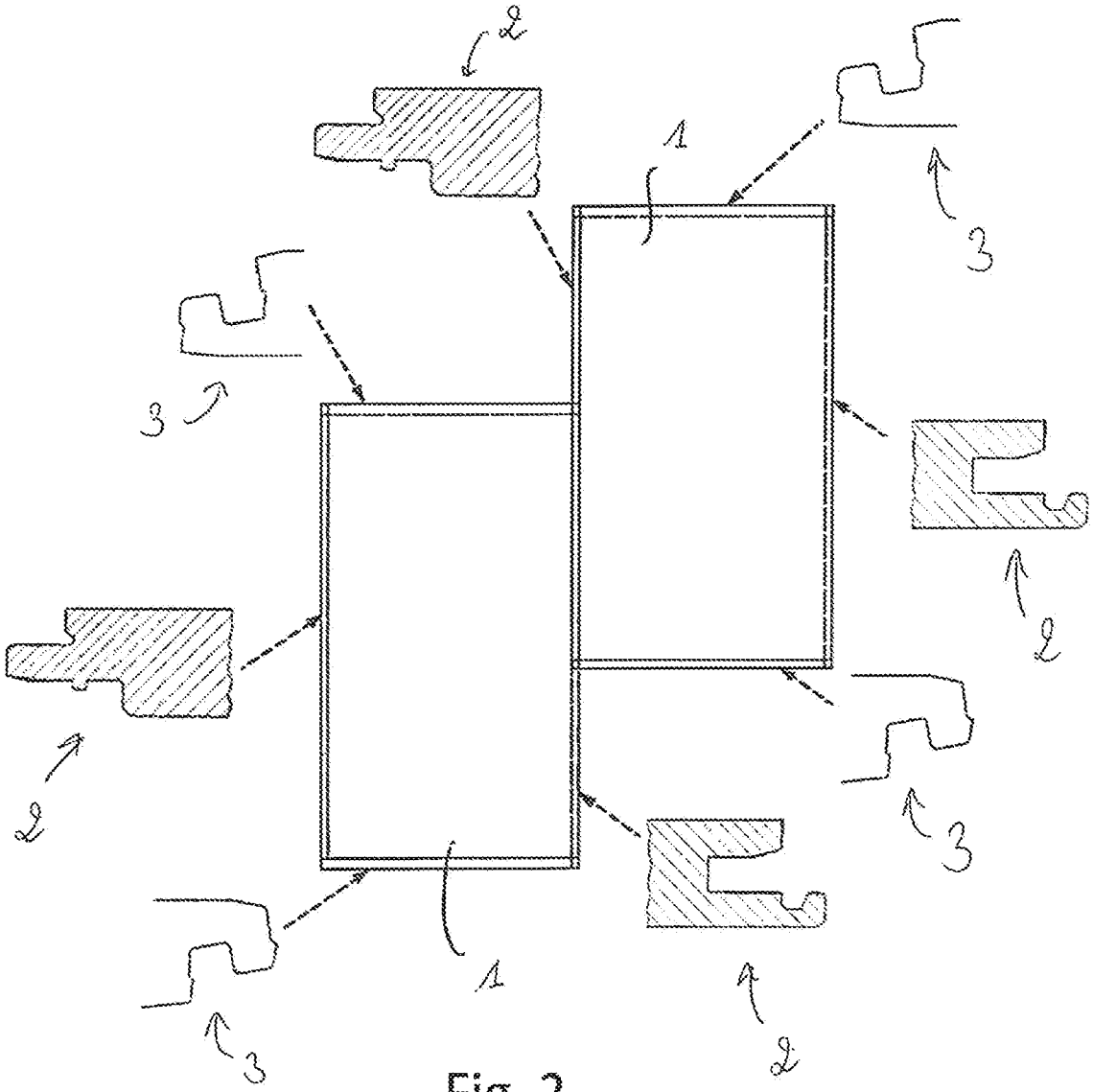
FIG. 2 is a diagrammatic representation of two panels in accordance with the invention, with two opposed edges for inclined assembly, and two opposed edges for vertical assembly.

With reference to FIG. 2, the invention concerns a panel (1) in the shape of a plank or tile for the production of a loose laid floor covering.

The floor panel (1) in accordance with the invention is preferably produced from a plastic material such as polyvinyl chloride, for example plasticized, and optionally comprising a mineral filler. Clearly, however, the panel (1) in accordance with the invention may be obtained from any appropriate plastic material.

In accordance with a particular embodiment, the panel (1) is resilient, for example produced from plasticized or rigid polyvinyl chloride.

Preferably, the panel (1) has a core bonded to a decorative layer constituted by a decor film bonded to a transparent surface layer.

The core may be single-layered or multi-layered and, for example, produced from a plastic material such as polyvinyl chloride, polypropylene, polyurethane, thermoplastic polyurethane, polyethylene, polyethylene terephthalate, or any other appropriate plastic material, and optionally comprising fillers in the form of fibres, chips, wood dust or sawdust and/or mineral fillers, for example chalk, lime, talc, and one or more plasticizers in order to define the rigidity of the core.

The core, or a layer of the core in the case of a multi layered core, may optionally be based on urea formaldehyde or melamine formaldehyde and wood, for example layers of medium density fibres (MDF) or high density fibres (HDF). Each layer may also be a layer of laminated wood or wood composite (WPC, wood plastic composite).

Each layer may be compact or foamed. By way of example, the core may be produced with a foamed layer of rigid polyvinyl chloride interposed between two layers of compact rigid polyvinyl chloride.

In known manner, the panel (1) comprises a rectangular shape and comprises two pairs of opposed sides defining four edges, of which two opposed edges are for inclined assembly (2), and two other opposed edges are for vertical assembly (3). Clearly, the panel (1) may also be square in shape.

From the foregoing, assembly of this type of panel (1) is carried out in accordance with an inclined movement on a first edge (2), for example at an angle of between 10° and 50°, and in accordance with a vertical movement on an adjacent second edge (3).

In particular, when fitting this type of panel (1), the fitter fits a first line of panels (1), by assembling them side by side in a vertical assembly movement. Next, the fitter starts a second line of panels (1) by assembling a first panel (1), in accordance with a movement which is inclined with respect to the panels (1) of the preceding line. The panels (1) of the second line are assembled in accordance with a movement which is inclined with respect to the panels (1) of the preceding line and, by a pivoting movement of the panel (1) in the direction of the floor, the panel (1) is assembled with the adjacent panel (1) in accordance with a vertical movement.

Preferably, when the panels (1) are rectangular in shape, the long sides are assembled in accordance with an inclined movement, while the short sides are assembled in accordance with a vertical movement.

Figure 3:
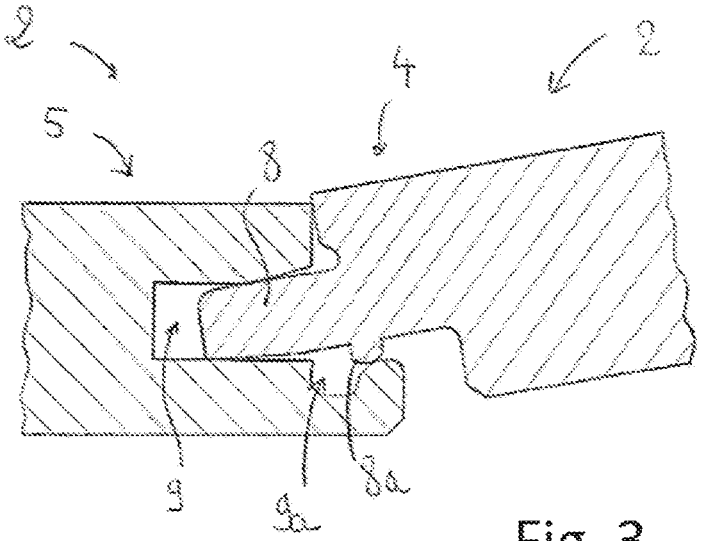
FIG. 3 is a partial cross sectional view of a particular embodiment of the edges for inclined assembly of two panels during the course of assembly.

Referring now to FIG. 3, the opposed edges for inclined assembly (2) consist of an edge comprising male coupling means (4) provided from a lateral wall of the panel (1), and of an opposed edge comprising complementary female coupling means (5) provided from a lateral wall of the panel (1).

Figure 4:
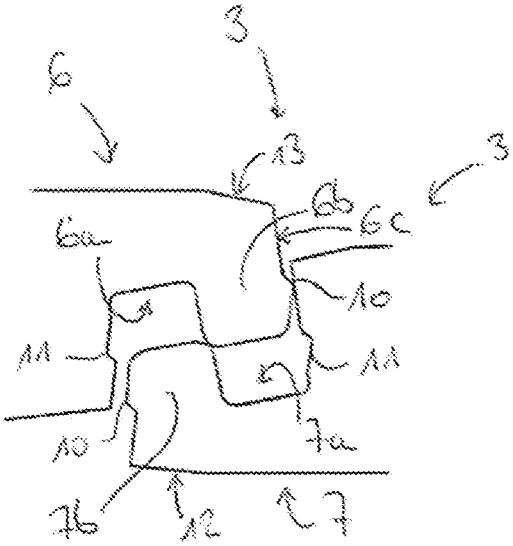
FIG. 4 is a partial cross sectional view of a particular embodiment of the edges for vertical assembly of two panels during the course of assembly.

With reference to FIG. 4, the opposed edges for vertical assembly (3) consist of an edge comprising male coupling means (6) provided from a lower face of the panel (1) and of an opposed edge comprising complementary female coupling means (7) provided from an upper face of the panel (1).

Figure 5:
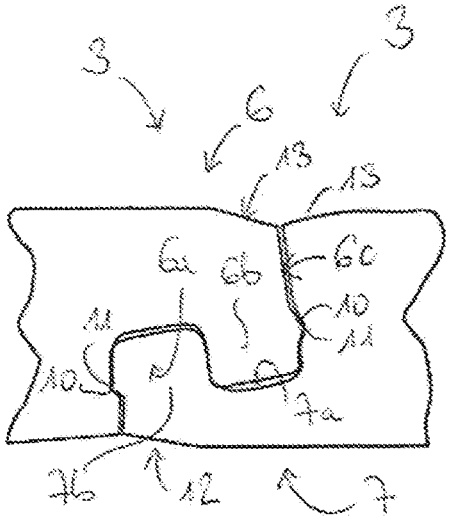
FIG. 5 is a partial cross sectional view similar to that of FIG. 4, with the two panels having been assembled.

With reference to FIG. 5, after assembly, the facing upper ridges the two panels (1) are preferably in contact for an optimal aesthetic appearance.

In accordance with the invention and with reference to FIG. 3, the male coupling means (4) of the inclined assembly edges (2) comprise a tongue (8) which protrudes from the lateral wall of the panel (1) and over the entire length of the edge. The female coupling means (5) of the inclined assembly edges (2) comprise a complementary groove (9) provided in the lateral wall of the panel (1) and over the entire length of the edge.

The cooperation between the tongue (8) and the groove (9) means that vertical uncoupling of the two panels (1) can be resisted in an optimal manner.

In order to resist horizontal uncoupling, the tongue (8) comprises a lug (8*a*) which protrudes vertically, and the complementary groove (9) comprises a complementary notch (9*a*) which, after assembly of two adjacent panels (1), forms stop abutments to counteract a horizontal displacement between two adjacent assembled panels (1). Clearly, the tongue (8) may comprise a notch and the groove (9) may comprise a lug without departing from the scope of the invention.

As mentioned above, engagement of the tongue (8) in the groove (9) occurs in accordance with an inclined movement, then by pivoting the panel (1), the tongue (8) is displaced horizontally towards the bottom of the groove.

Figure 6:
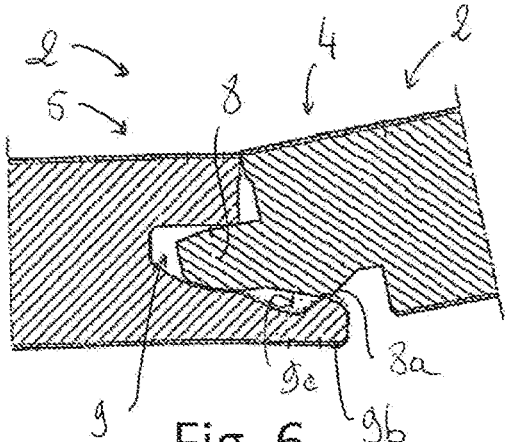
FIG. 6 is a partial cross sectional view of another particular embodiment of the edges for inclined assembly of two panels during the course of assembly.

In accordance with another embodiment of the opposed inclined assembly edges (2) illustrated in FIG. 6, the complementary groove (9) of the female coupling means (5) defines a flexible lower female tongue (9*b*) which is intended to be displaced during inclined engagement of the tongue (8) of the male coupling means (4), then to resume its position after engagement in order to increase the resistance to vertical and horizontal uncoupling of two adjacent panels (1).

With reference to FIGS. 4 and 5, the male coupling means (6) of the vertical assembly edges (3) comprise a male, groove (6*a*) extending along the edge and opening onto the lower face of the panel (1) in a manner such as to define a male tenon (6*b*).

In the same manner, the female coupling means (7) of the vertical assembly edges (3) comprise a female groove (7*a*) extending along the edge and opening onto the upper face of the panel (1) in a manner such as to define a female tenon (7*b*).

The male and female tenons (6*b*, 7*b*) comprise substantially rectangular cross sections and are flexible and elastically deformable in order to allow them to engage in the corresponding female and male grooves (6*a*, 7*a*).

The male tenon (6*b*) has an outer wall (6*c*) which is inclined with respect to a vertical plane and towards the outside of the panel (1), at an angle of between 1° and 45°, and preferably of between 5° and 15°. An inclination of the outer wall (6*c*) of between 5° and 15° can be used to obtain a good compromise between the ease of assembly of the panels and resistance to horizontal uncoupling of the coupling means. Thus, during engagement of the male tenon (6*b*) in the female groove (7*a*) in accordance with a vertical movement, the male tenon (6*b*) will come into abutment with the upper portion of the female tenon (7*b*). As a consequence, during the fitting operation, the fitter can see the female groove (7*a*) and can therefore easily position the outer wall (6*c*) of the male tenon (6*b*) level with the female groove (7*a*) in order to commence assembly. This very substantially facilitates the vertical assembly operation during the rotational movement. Furthermore, and in an advantageous manner, given the inclination towards the outside of the outer wall (6*c*) of the male tenon (6*b*) and the complementary inclination of the inner wall of the female groove (7*a*), the two panels (1) approach each other during pivoting. This further facilitates the fitting operation and machining constraints which are involved ire the production of a perfect contact at the surface of the panels (1) are also easier to accommodate.

In accordance with a particular embodiment, the male tenon (6*b*) has an inner wall which is inclined with respect to a vertical plane and towards the outside or inside of the panel (1).

Preferably, and to facilitate assembly of two adjacent panels (1), the male tenon (6*b*) has an inner wall which is inclined towards the outside of the panel (1) at an angle of between 1° and 45°, and preferably of between 5° and 15°. An inclination of the inner wall of the male tenon (6*b*) of between 5° and 15° also enables a good compromise to be obtained between the ease of assembly of the panels and the resistance to horizontal uncoupling of the coupling means. More preferably, the male tenon (6*b*) has an inner wall which is inclined at the same angle as the outer wall (6*c*). This feature also means that manufacture is facilitated, and in particular machining of the complementary male (6) and female (7) coupling means.

The engagement of the male tenon (6*b*) in the female groove (7*a*) means that horizontal uncoupling of two assembled panels (1) can be resisted.

In order to contribute to the resistance to vertical uncoupling, the male coupling means (6) of the vertical assembly edges (3) comprise a lug (10) or a notch (11), and the female coupling means (7) of the vertical assembly edges (3) comprise a complementary notch (11) or a lug (10) which, after assembly of two adjacent panels (1), form stop abutments which counteract a vertical displacement between two adjacent assembled panels (1).

A number of embodiments may be envisaged from the foregoing. As an example, the lug (10) or notch (11) is provided in the outer wall of the male tenon (6*b*) and in a complementary manner, the notch (11) or lug (10) is provided on an inner wall of the female groove (7*a*).

In accordance with another embodiment, the lug (10) or notch (11) is provided on the outer wall of the female tenon (7*b*) and, in a complementary manner, the notch (11) or lug (10) is provided on an inner wall of the male groove (6*a*).

Preferably, these two embodiments are combined in a manner such that the male coupling means (6) of the vertical assembly edges (3) comprise two lugs (10) or notches (11), and the female coupling means (7) of the vertical assembly edges (3) comprise two complementary notches (11) or lugs (10).

In order to further improve the resistance to vertical uncoupling, the male (6*a*) and female (7*a*) grooves each have an outer wall, i.e. not positioned on the side of the body of the panel (1), but positioned on the side of the outside of the panel (1), which are intended to come into contact after assembly of the two panels (1). In order to obtain contact, the grooves (6*a*, 7*a*) and tenons (6*b*, 7*b*) have appropriate widths and/or inclinations. By way of example, the tenons (6*b*, 7*b*) and grooves (6*a*, 7*a*) have widths of the order of 2 mm, and are inclined by 10° with respect to the vertical and towards the outside of the panel (1).

Thus, the outer wall of the male groove (6*a*) is in contact with the outer wall of the female groove (7*a*). In practice, after assembly, these walls which are in contact are parallel to each other. After assembly, and preferably, the male tenon (6*h*) is in contact with the bottom of the female groove (7*a*) for vertical abutment. Furthermore, after assembly, there is preferably a clearance of a few tenths of a millimetre between the outer vertical wall of the female tenon (7*b*) located below the notch (11) and the vertical wall facing the male groove (6*a*) located below the lug (10). This feature can facilitate assembly.

In accordance with another feature of the invention, the female tenon (7*b*) comprises a chamfered portion (12) at the level of the lower face of the panel (1) and forms an angle of between 2° and 20° with respect to the lower face of the panel (1). Thus, during assembly of two adjacent panels (1), the chamfered portion (12) permits the female tenon (7*b*) to drop down in order to come into contact with the floor by deformation and thereby ensure a reduction in the force of assembly. In order to further facilitate the assembly operation, the chamfered portion (12) of the female tenon (7*h*) extends up to level with the upper inner ridge of the female tenon (7*b*).

Furthermore, the upper face of the panel (1) may also have chamfers 13) at the level of the male tenon (6*b*) and of the female groove (7*a*) in order to contribute to the general aesthetic appearance of the panels (1) after assembly. Each chamfer (13) forms an angle of between 2° and 20° with respect to the upper face of the panel (1). The interface between the two assembled panels (1) then forms a V-shaped groove, see FIG. 5.

It is apparent from the foregoing that the invention in fact provides a panel (1) for the production of a loose laid floor covering for which assembly is facilitated, while having an optimal resistance to horizontal and vertical uncoupling, as well as a satisfactory aesthetic appearance.

What is claimed:

1. A panel having a shape of a plank or a tile for a production of a floor covering, the panel comprising two pairs of opposed sides defining:

two opposed edges configured for inclined assembly, wherein one edge comprises male coupling means provided from a lateral wall of the panel, and an opposed edge comprising complementary female coupling means provided from a lateral wall of the panel;

two opposed edges configured for vertical assembly, wherein one edge comprises male coupling means provided from a lower face of the panel, and an opposed edge comprising complementary female coupling means provided from an upper face of the panel;

wherein:

the male coupling means of the edges for vertical assembly comprise a male groove extending along the edge and opening onto the lower face of the panel in a manner to define a male tenon, the male tenon having an outer wall that is inclined with respect to a vertical plane and towards the outside of the panel;

the female coupling means of the edges for vertical assembly comprise a female groove extending along the edge and opening onto the upper face of the panel in a manner to define a female tenon;

the male coupling means of the edges for vertical assembly comprise a male groove extending along the edge and opening onto the lower face of the panel in a manner to define a male tenon, the male tenon having an outer wall inclined with respect to a vertical plane and towards the panel and an inner wall inclined with respect to said vertical plane and towards the panel at the same angle as the outer wall.

2. The panel as claimed in claim 1, wherein the female tenon comprises a portion which is chamfered at a level of the lower face of the panel and forms an angle of between 2° and 20° with respect to the lower face of the panel.

3. The panel as claimed in claim 2, wherein the chamfered portion of the female tenon extends to level with an upper inner ridge of the female tenon.

4. The panel as claimed in claim 1, wherein the male tenon has an inner wall which is inclined with respect to a vertical plane and towards the outside of the panel.

5. The panel as claimed in claim 1, wherein the outer wall and inner wall of the male tenon are inclined at an angle of between 1° and 45°.

6. The panel as claimed in claim 5, wherein the outer wall and inner wall of the male tenon are inclined at a same angle.

7. The panel as claimed in claim 1, wherein the male tenon comprises a portion which is chamfered at a level of the upper face of the panel and which forms an angle of between 2° and 20° with respect to the upper face of the panel.

8. The panel as claimed in claim 1, wherein the lug or notch is provided on the outer wall of the male tenon and, in a complementary manner, the notch or lug is provided on an inner wall of the female groove.

9. The panel as claimed in claim 1, wherein the lug or notch is provided on the outer wall of the female tenon and, in a complementary manner, the notch or lug is provided on an inner wall of the male groove.

10. The panel as claimed in claim 1, wherein the male coupling means of the edges for vertical assembly comprise two lugs or notches, and the female coupling means of the edges for vertical assembly comprise two complementary notches or lugs.

11. The panel as claimed in claim 1, wherein the male coupling means of the edges for inclined assembly comprise a tongue which protrudes from the lateral wall of the panel and over an entire length of the edge, and the female coupling means of the edges for inclined assembly comprise a complementary groove provided in the lateral wall of the panel and over an entire length of the edge.

12. The panel as claimed in claim 11, wherein the tongue comprises a lug which protrudes vertically, and the complementary groove comprises a complementary notch which, after assembly of two adjacent panels, form abutment stops to counteract a horizontal displacement between two adjacent assembled panels.

13. The panel as claimed in claim 11, wherein the groove defines a flexible lower female tongue which is intended to be displaced during inclined engagement of the tongue of the male coupling means, then to resume a position after engagement in order to increase the resistance of the two adjacent assembled panels to vertical and horizontal uncoupling.

14. The panel as claimed in claim 1, wherein the outer wall and inner wall of the male tenon are inclined at an angle of between 5° and 15°.

* * * * *